United States Patent [19]

Bordi et al.

[11] Patent Number: 4,784,094

[45] Date of Patent: Nov. 15, 1988

[54] CYLINDER HEAD WITH DESMODROMIC VALVE OPERATION, FOR INTERNAL COMBUSTION ENGINES

[75] Inventors: Ing. M. Bordi; P. I. Gianluigi Mengoli, both of Bologna, Italy

[73] Assignee: Ducati Meccanica S.p.A., Bologna, Italy

[21] Appl. No.: 34,071

[22] Filed: Apr. 2, 1987

[30] Foreign Application Priority Data

Apr. 8, 1986 [IT] Italy ..... 21471 B/86[U]

[51] Int. Cl.[4] ..... F01L 1/30

[52] U.S. Cl. ..... 123/90.25; 123/90.39

[58] Field of Search ..... 123/90.24, 90.25, 90.26, 123/90.39

[56] References Cited

U.S. PATENT DOCUMENTS

| | | | |
|---|---|---|---|
| 1,349,089 | 8/1920 | Ohet | 123/90.39 |
| 1,633,882 | 6/1927 | Ballot | 123/90.25 |
| 2,298,981 | 10/1942 | Smith | 123/90.39 |
| 2,814,283 | 11/1957 | Gassmann et al. | 123/90.24 |
| 2,908,262 | 10/1959 | Gropp | 123/90.39 |
| 2,982,274 | 5/1961 | Brown | 123/90.24 |
| 3,150,648 | 9/1964 | Gropp | 123/90.39 |
| 4,086,887 | 5/1978 | Schoonover et al. | 123/90.39 |
| 4,401,064 | 8/1983 | Nakamura et al. | 123/90.39 |
| 4,402,284 | 9/1983 | Honma | 123/90.39 |
| 4,488,520 | 12/1984 | Hmor | 123/90.39 |

*Primary Examiner*—Willis R. Wolfe
*Assistant Examiner*—M. Macy
*Attorney, Agent, or Firm*—Ladas & Parry

[57] ABSTRACT

In a cylinder head with desmodromic valve operation for internal combustion engines, where the operation is implemented by two rockers for each valve which control its closure and opening respectively and which act on the valve stem by way of calibrated registers.

The rocker for opening the valve is mounted with two degrees of freedom on its pin. One of these degrees of freedom relates to its ability to rotate about the pin and the other to its ability to translate along the pin. By utilizing this second degree of freedom, the rocker can be moved onto and off the valve.

6 Claims, 3 Drawing Sheets

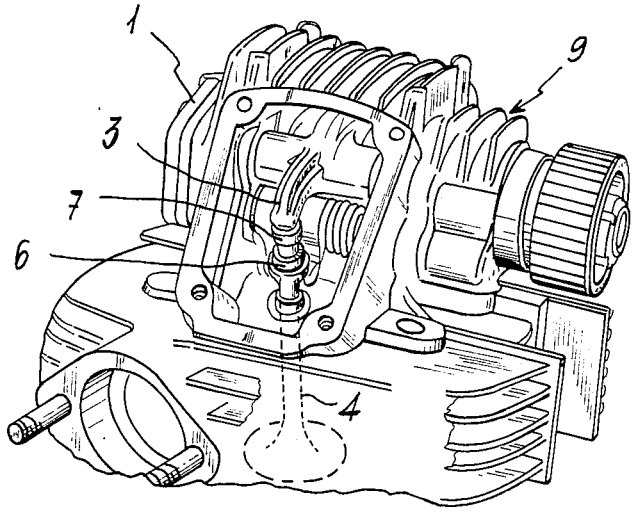
PRIOR ART Fig. 1
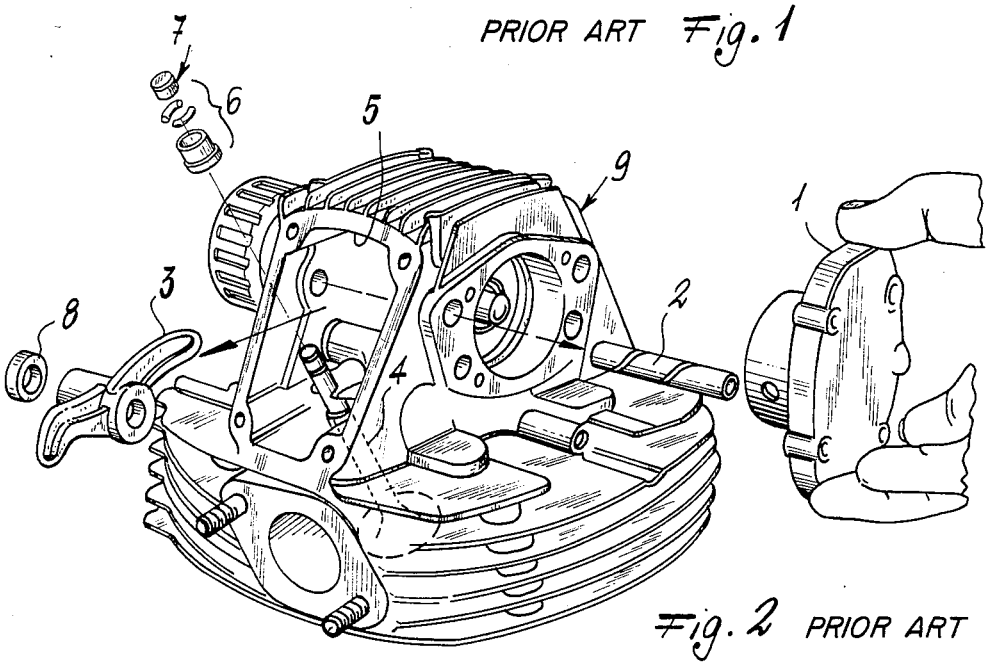
Fig. 2 PRIOR ART

CYLINDER HEAD WITH DESMODROMIC VALVE OPERATION, FOR INTERNAL COMBUSTION ENGINES

This invention relates to a cylinder head with desmodromic valve operation for internal combustion engines, this operation being implemented by means of two rockers for each valve, which control its opening and closure respectively, and which act on the valve stem by way of the so-called calibrated registers.

BACKGROUND OF THE INVENTION

In known engines of this type, the assembly or replacement of the calibrated register both during engine production and during the life of the engine itself if a long and relatively complex operation. For example, with reference to FIGS. 1 and 2 which show perspective views of a known desmodromic cylinder head 9 of a four-stroke internal combustion engine, said operation involves removing a side cover 1, extracting the pin 2 on which the rocker 3 for opening the valve 4 is mounted so as to be able to extract the rocker (with its spacer washer 8) from the cylinder head 9 through an aperture 5 therein after removing the relative cover, not shown. Only then can the two registers 6 and 7 be removed from the stem of the valve 4 and replaced with new ones, repeating the described operations in the reverse order.

An object of the present invention is to provide a desmodromic cylinder head of the stated type which because of the particular conformation and arrangement of its parts, allows reduction both in register assembly time during production and in register adjustment time during periodic checking by the user or mechanic.

This and further objects which will be more apparent from the detailed description given hereinafter are attained by a cylinder head with desmodromic valve operation of the stated type in that the valve opening rocker is mounted with two degrees of freedom on its pin, one of these degrees of freedom relating to its ability to rotate about the pin and the other to its ability to translate along the pin, so that by utilising this second degree of freedom the rocker can be moved laterally onto or off the valve stem.

Advantageously, to the side of the rocker there is provided on its pin a spacer element to prevent undesirable lateral movement of the rocker.

Advantageously, the spacer element is a spring clip which could also be a helical spring (121) that is easily mounted on and removed from the pin.

THE BRIEF DESCRIPTION OF DRAWINGS

FIGS. 1 and 2 are perspective views of a conventional cylinder head, with the registers mounted in FIG. 1 and with the registers and other parts removed in FIG. 2, the purpose of this latter being to visually illustrate the difficulty in the initially described operation of replacing the registers;

Figure 3:
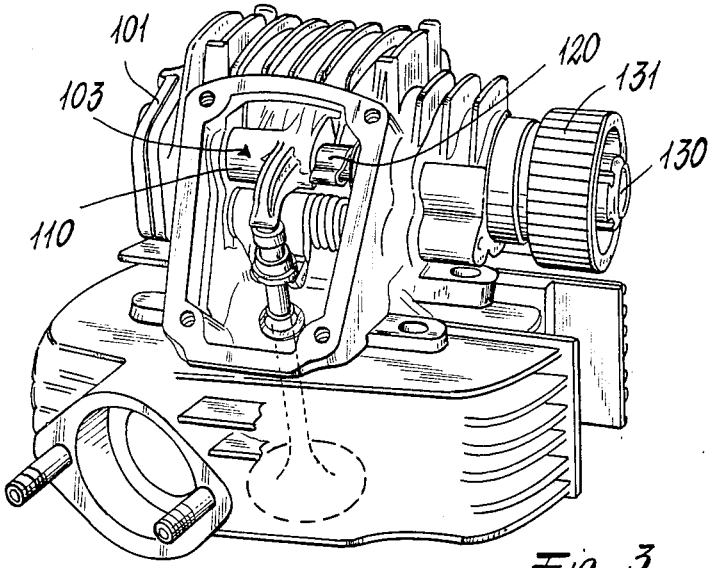
FIGS. 3 and 4 are perspective views of the cylinder head according to the invention in analogous situations to those of the two preceding figures.
Figure 4:
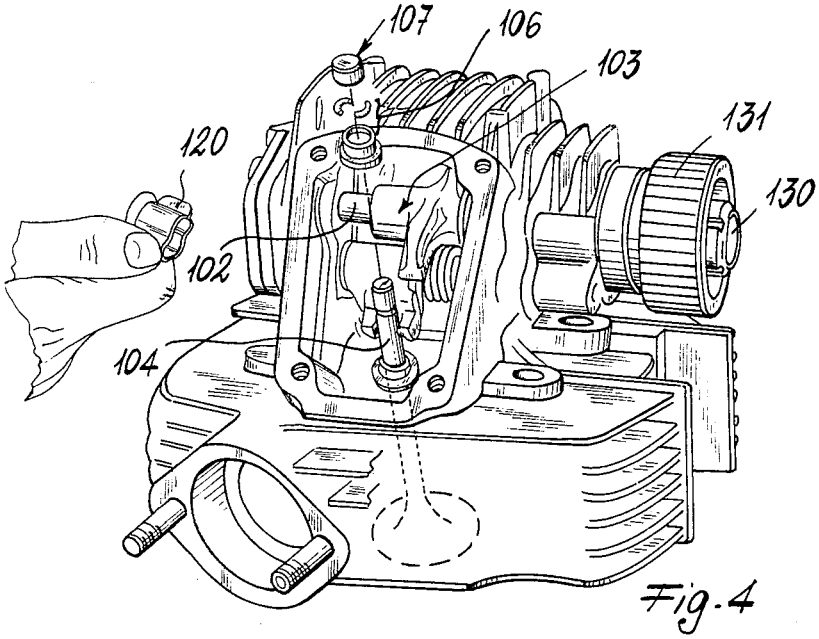
Figure 5:
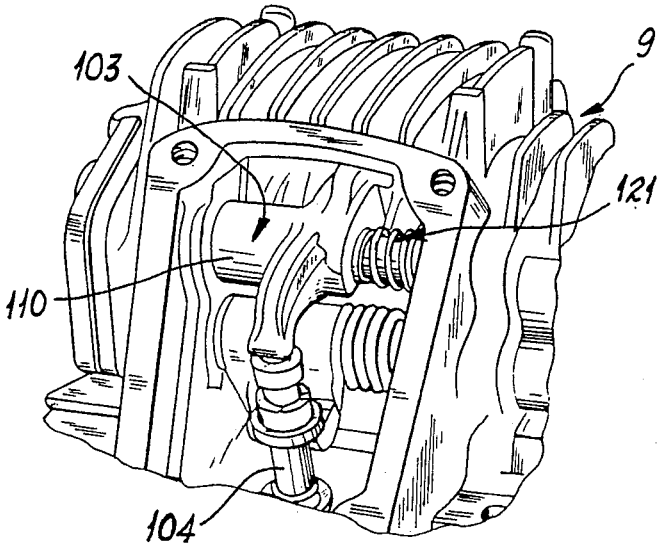
FIG. 5 is a perspective view of the cylinder head.

In FIGS. 3 and 4, in which parts equal or similar to those of the preceding figures are given the same reference numerals as in FIGS. 1 and 2 but with the addition of 100, it can be seen that on the pin 102 there are mounted a rocker 103 and the supporting bush 110 which does not extend over the whole or nearly the whole of the free length of the pin 102. Instead, the length of this bush or, in other words, the transverse dimension of the rocker 103 is such that the rocker can be moved laterally along the pin 102 so as to withdraw it from the conventional registers 106, 107 situated on the valve stem 104 so as to allow them to be easily and comfortably replaced. The rocker 103 therefore possesses two degrees of freedom, one of rotation about the axis of the pin 102, and the other of translation along the axis thereof.

Advantageously, to the side of the rocker 103 when positioned in its operating position (i.e., in that shown in FIG. 3), there is mounted an easily removable lateral spacer, preferably in the form of a spring clip indicated by 120, mounted on the pin 102 to the side of the rocker.

The registers 106, 107 are replaced in the following manner: The camshaft 130 which controls the rocker movement is rotated by the toothed wheel 131, which drives it and is keyed to it, until the point at which the rocker no longer presses on the stem of the valve 104. The clip 120 is then removed from the pin 102 and the rocker 103 is moved laterally along the pin so as to withdraw it from the valve stem. The two registers 106, 107 are then removed from the stem (FIG. 4) and are replaced with new ones. The rocker 103 is returned onto the stem by sliding it along the pin 102, and the clip 120 is repositioned.

What is claimed is:

1. A cylinder head for desmodromic valve operation for internal combustion engines which comprises:

a first rocker assembly comprising a pin having a major axis; a first rocker arm rockingly and slidably mounted on said pin such that said rocker may move at least along the axis of said pin; and a support bushing rotatably mounted on said pin, said support bushing being shorter in length than said pin so as to permit lateral displacement of said first rocker, said first rocker assembly operable to control the opening of said desmodromic valve; wherein said movement of said first rocker along the axis of said pin facilitates engagement and withdrawl of said first rocker from said valve so that access to a plurality of calibrated registers positioned on said valve is permitted without disengaging said rocker assembly.

2. The cylinder head as claimed in claim 1, further comprising a spacer element rotatably mounted on said pin and placed next to said first rocker.

3. The cylinder as claimed in claim 2, wherein said spacer element is a helical spring surrounding said pin so that said first rocker is disengaged from said valve by means of compressing said helical spring.

4. The cylinder head as claimed in claim 2, wherein said spacer element is removable from said pin.

5. The cylinder head as claimed in claims 2 or 4, wherein said spacer element is a spring clip.

6. The cylinder head as claimed in claim 1, further comprising a second rocker assembly for closing said desmodromic valve

* * * * *